United States Patent [19]

Graul et al.

[11] Patent Number: 4,697,752

[45] Date of Patent: Oct. 6, 1987

[54] COIL WINDING MACHINE

[75] Inventors: Otto Graul, Bamberg; Herbert Oppelt, Frensdorf, both of Fed. Rep. of Germany

[73] Assignee: MWB Messwandler-Bau Aktiengesellschaft, Fed. Rep. of Germany

[21] Appl. No.: 760,044

[22] Filed: Jul. 26, 1985

[30] Foreign Application Priority Data

Aug. 3, 1984 [DE] Fed. Rep. of Germany ... 8423162[U]

[51] Int. Cl.[4] ..... B65H 81/06

[52] U.S. Cl. ..... 242/7.11; 242/7.21

[58] Field of Search ..... 242/7.21, 7.22, 7.23, 242/56.1, 67.3 R, 2, 3, 7.11, 18 R, 35.5 R

[56] References Cited

U.S. PATENT DOCUMENTS 688,372 12/1901 Wilcox ..... 242/7.22

2,024,178 12/1935 Morrisey ..... 242/7.11

2,867,074 6/1959 Newton ..... 57/360

4,548,364 10/1985 Pederson ..... 242/7.21

*Primary Examiner*—Billy S. Taylor

[57] ABSTRACT

A coil winding machine with a coil clamping and rotating mechanism for a coil to be clamped-in horizontally which is to be so constructed that the finished-wound coil with great length and/or great weight can be easily removed from above by means of a crane or a trolley hoist and then carried away. This is achieved in that the winding material feed devices (12, 13, 14) are arranged at a common bearer (10) and are pivotally supported together with the bearer about an axis (11) disposed to the rear of the coil rotating axis (15) in such a manner that the transfer or guide rollers (16, 17, 18) are adapted to be pivoted out of the space (20) that exists vertically above the coil (19), and the coil (19) can then be removed vertically in the upward direction.

19 Claims, 4 Drawing Figures

COIL WINDING MACHINE

BACKGROUND AND SUMMARY OF THE INVENTION

The present invention relates to a coil winding machine with an arrangement for clamping and rotating a coil to be clamped-in horizontally.

With such a known coil winding machine the guide rollers are slightly pivotal in the upward direction. The wound coil is removed forwardly in these prior art machines.

the problem is to be solved with the present invention to so construct such a coil winding machine that the coil, also in case of greater length and of large up to very large weight, cn be removed easily from the coil winding machine and without damaging the same.

The underlying problems are solved according to the present invention in that the winding material feed devices are arranged on a common bearer and are pivotally supported together with this bearer about an axis located to the rear of the axis of rotation of the coil in such a manner that the transfer or guide rollers are adapted to be pivoted out of the space present vertically above the coil and the coil can be removed vertically in the upward direction.

With the construction of the coil winding machine in accordance with the present invention the finished-wound coil can be easily removed from above by means of a crane or a trolley hoist and can then be transported away.

These and further objects, features and advantages of the present invention will become more apparent from the following description when taken in connection with the accompanying drawing which shows, for purposes of illustration only, one embodiment in accordance with the present invention, and wherein:

DETAILED DESCRIPTION OF THE DRAWINGS

Figure 1:
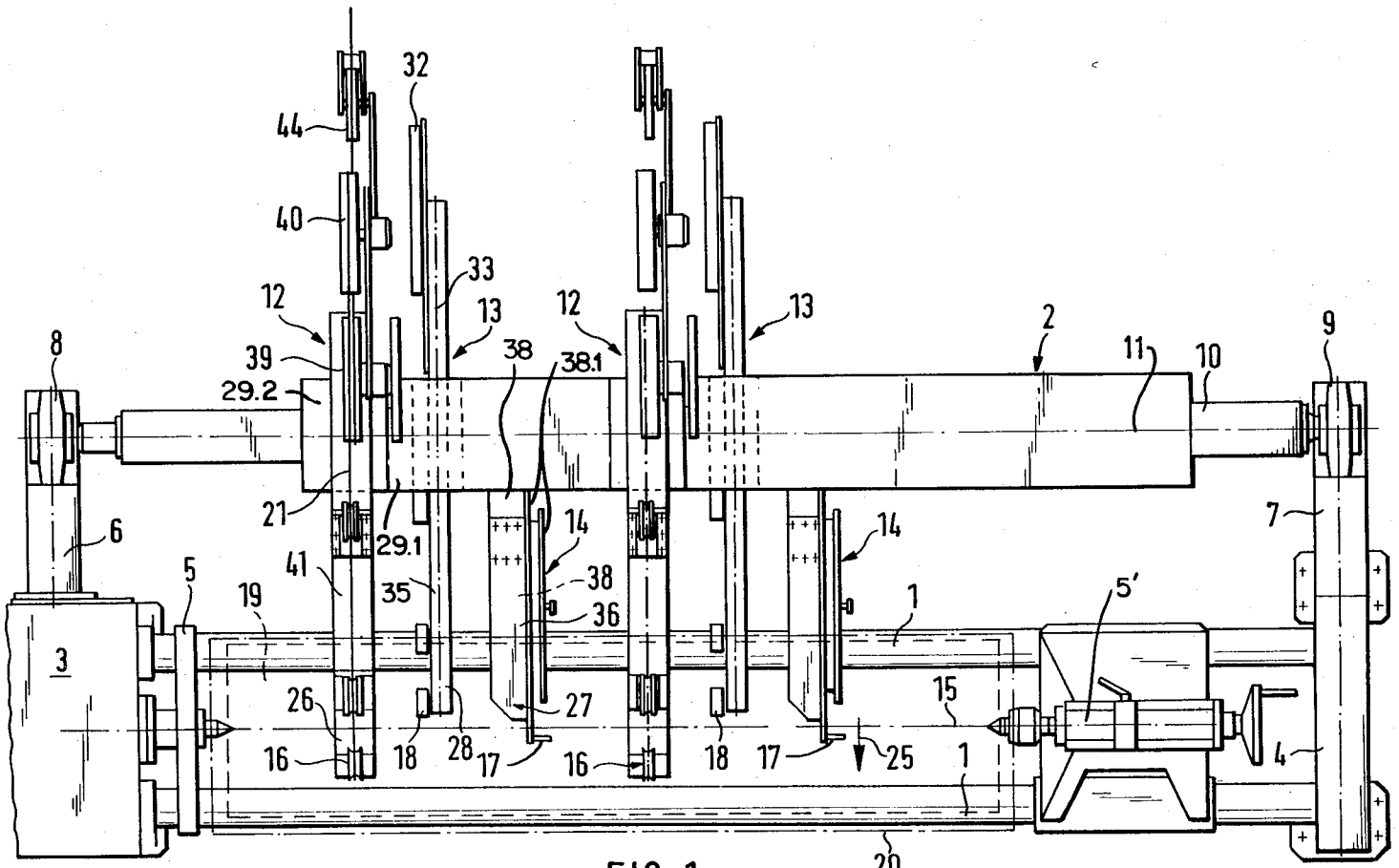
FIG. 1 is a somewhat schematic top plan view on the coil winding machine in accordance with the present invention, in the winding position thereof.

Referring now to the drawing wherein like reference numerals are used throughout the various views to designate like parts, reference numeral 1 designates a guide bed consisting, for example of two steel pipes, of a coil winding machine generally designated by reference numeral 2; the guide bed 1 is rigidly connected with lateral pedestal supports 3 and 4. The left pedestal support 3 is provided with a drive mechanism which is able to drive a driving disk 5 by way of appropriate control electronics according to a predetermined winding program. The driving disk 5 in combination with clamp 5' which rides on guide bed 1, clamps coil in place for winding.

A rearwardly projecting support arm 6 and 7 is attached to each of the base frame or pedestal supports 3 and 4. A rotary or pivot bearing 8, 9 is arranged at the ends of the support arms 6, 7, in which a bearer 10 is rotatably respectively pivotally supported about an axis 11. Advantageously, the bearer 10 is formed of a rectangular tubular member.

Figure 2:
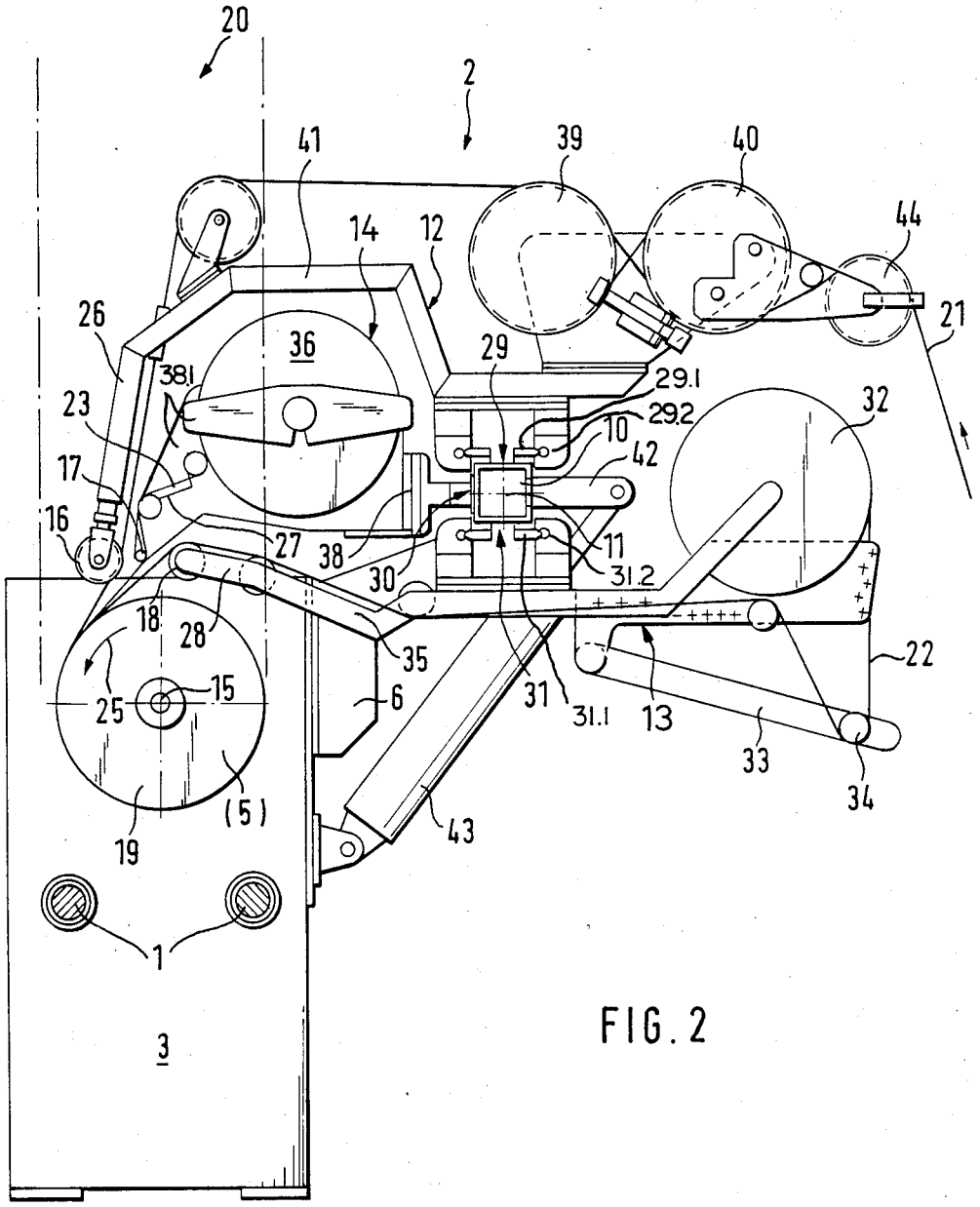
FIG. 2 is a somewhat schematic side elevational view of the coil winding machine of FIG. 1, in the winding position thereof.
Figure 3:
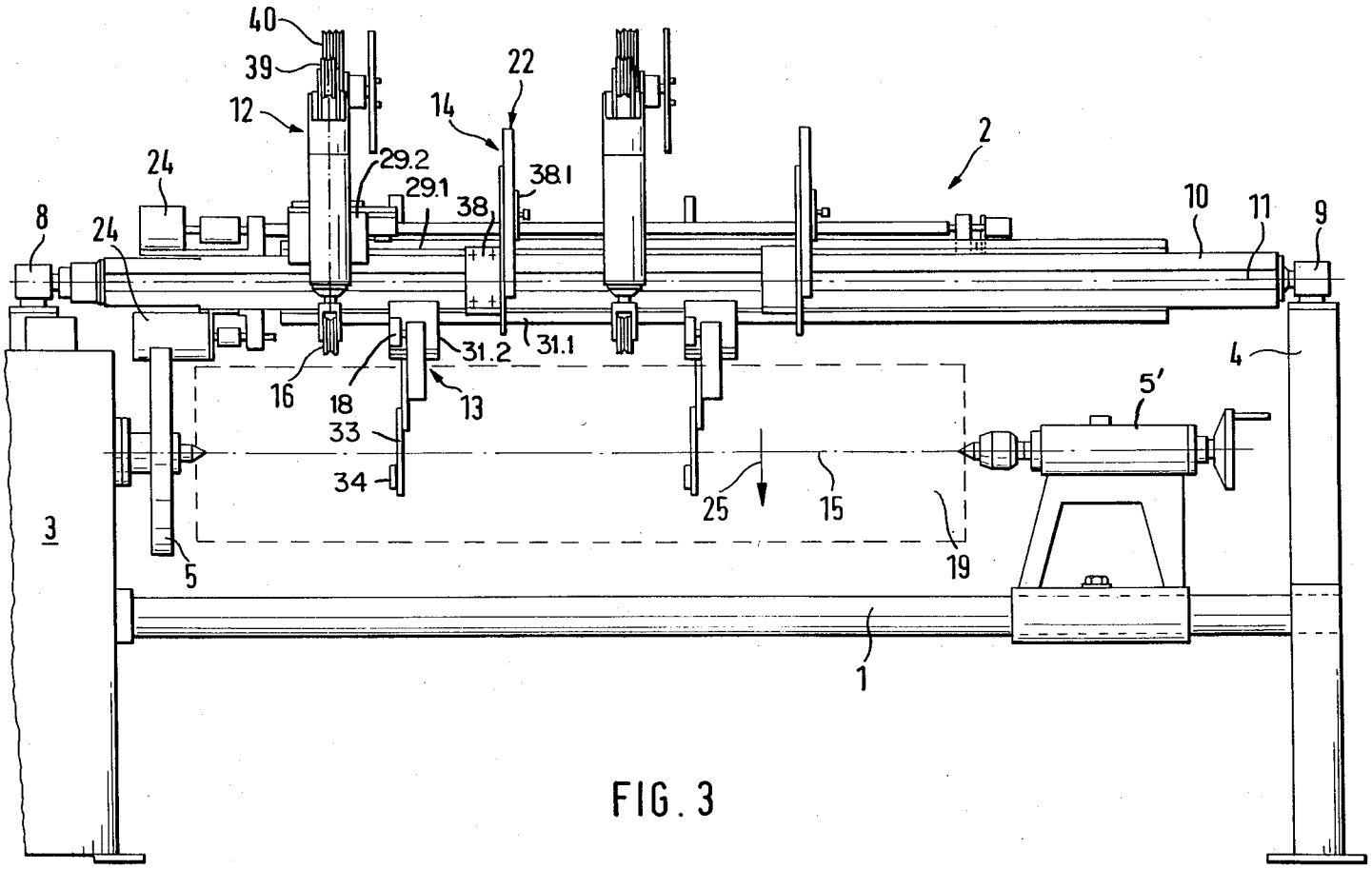
FIG. 3 is a somewhat schematic front elevational view of the coil winding machine of FIG. 1, in the winding position thereof.
Figure 4:
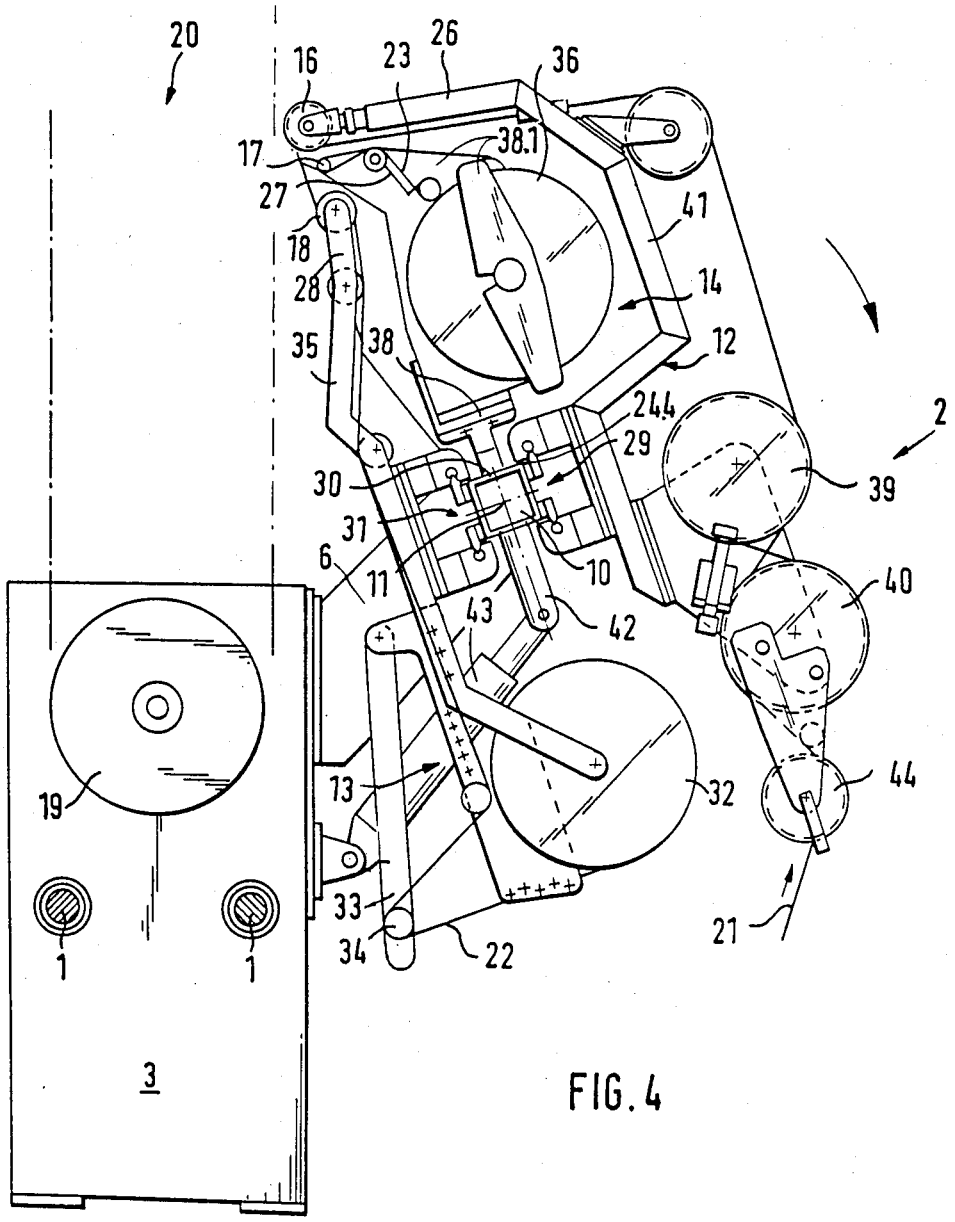
FIG. 4 is a somewhat schematic side elevational view of the coil winding machine, similar to FIG. 2, but illustrating the coil winding machine in a fully retracted position.

In the illustrated embodiment, three feed devices for the winding material which are generally designated by reference numerals 12, 13 and 14 are arranged on the common bearer 10 to the rear of the axis of rotation 15 of the coil and are pivotal together with the bearer 10. The pivoting range is chosen so large that the transfer or guide rollers 16, 17, and 18 respectively coordinated to the winding material feed devices 12, 14 and 13 are pivoted from the winding position of FIG. 2 to out of the space 20 present vertically above the coil 19 to be wound, as illustrated in FIG. 4. The contours of coil 19 and space 20 are indicated in FIGS. 1 and 3 in dash lines. Thus the coil 19 can be lifted out vertically upwardly, for example by a crane or a trolley hoist.

In order that the coil 19 can be wound with different winding materials, i.e. for example with a wire 21, an insulating tape 22, intermediate layers 23, preferably of Pressspan or the like at any desired pitch—mutually leading or trailing—, the winding material feed devices 12, 13 and 14 are displaceable independently of one another on their own guide carriages (29.2, 31.2, 30) or the like on the bearer 10 in the direction of the axis of rotation 15 of the coil and are adjustable in particular by way of separate electric drive devices 24, of which only two are illustrated in FIG. 3.

In order to be able to carry out also with the pivotal construction described herein a leading or trailing winding with the winding material 21, 22, 23 in a simple manner without interruption of the winding operation, the guide rollers 16, 18, 17 coordinated respectively to the winding material feed devices 12, 13, 14 are arranged one behind the other in the coil winding direction of the arrow 25 (FIG. 2) on correspondingly coordinated lever arms 26, 28, 27 which extend one above the other. Furthermore, the winding material feed devices 12, 13, 14 are displaceable on the bearer 10 on adjacent, but independent guide tracks 29, 31, 30 and they are also supported movable past one another—not interfering with one another. Among others, a supply roll 32 coupled with the winding material feed device 13, for example, for an insulating paper 22 or an insulating film and a tape brake 33 with a deflection roller 34 are thereby displaceably arranged additionally on the lower guide track 31, whereby the coordinated guide roller 18 is secured at a support arm 35 projecting directly toward the coil 19. The lower guide track 31 includes a pair of guide rails 31.1 mounted to bearer 10 and a carriage 31.2 to which is mounted a winding material feed device 13.

The center guide track 30 serves for the displacement of the winding material feed device 14 which is equipped with a supply roll 36 secured by plates 38.1, for example, for the insertion of special insulating strips, preferably of edge strips 23. The coordinated guide roller 17 is secured at a support arm 38 which extends over the aforementioned guide roller 18. The center guide track 30 slidably receives support arm 38.

Finally, a wire brake of winding material feed device 12 consisting of two brake rollers 39 and 40 is provided on the upper guide track 29, by way of which the wire 21 to be wound is drawn in the form of an eight. Moreover, the guide roller 16, which is secured on a support arms 26, 41, is mounted thereat; the guide roller 16 thereby extends over the aforementioned two guide rollers 18 and 17. The upper guide track 29 includes a pair of guide rails 31.1 mounted to bearer 10 and a carriage 31.2 to which is mounted winding material feed device 12. As a result thereof, also the individual guide rollers 16, 17 and 18 do not interfere with one another when one passes the other during winding.

For pivoting the winding material feed devices, possibly together with eventually present supply rolls 32 and 36 and brake rollers 39, 40 or the like, a rearwardly projecting pivot lever 42 is mounted on the bearer 10. The pivot lever 42 is pivotally coupled with a pivot drive element 43 constructed as pneumatic or hydraulic cylinder or as electro-spindle drive. The pivot drive element 43 is supported between the pivot lever 42 and one of the pedestal supports 3 or 4 underneath the support arms 6 or 7 thereof. A second such element may also be provided at the second pedestal support 4 or 3.

According to an advantageous construction of the present invention, a supply roll 32, for example, for the paper tape 22 and the wire brake consisting of the brake rollers 39, 40 and/or a wire withdrawal roller 44 are provided to the rear of the bearer 10 whereas the supply roll 36, for example, for the Pressspan strips 23 is provided forwardly between the support arms 35 and 41. As a result thereof, the bearer 10 is approximately in the center of gravity of the winding material feed devices 12, 13 and 14 so that only a slight force is necessary for pivoting the entire arrangement.

While we have shown and described only one embodiment in accordance with the present invention, it is understood that the same is not limited thereto, but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A coil winding machine comprising:

support means;

clamping and rotating means for clamping and rotating a coil about a horizontal axis of rotation of said support means;

a common bearer means pivotally mounted to said support means about an axis disposed to the rear of the axis of rotation of the coil;

a plurality of winding material feed means mounted to said common bearer means to rotate therewith, and each including a supply means and at least one guide roller means;

means for defining for said common bearer means a winding position extending sid guide roller means in a space vertically about said coil and a retracted position removing said guide roller means and any supply means in said space vertically above said coil out of the space vertically above the coil so that the coil can be removed vertically upwardly.

2. A coil winding machine according to claim 1, including displacement means for displaceable and adjustable mounting said winding material feed means to move on the bearer means independently of one another in the direction of the axis of rotation of the coil;

wherein said winding material feed means includes lever arm means displaced vertically one above the other, and said roller means being arranged on a respective lever arm means and spaced along a direction of rotation of the coil.

3. A coil winding machine according to claim 2, wherein said support means includes a guide bed means having ends, pedestal support means each including a rearwardly projecting support arm provided at said ends of the guide bed means, the bearer means being supported at the support arm.

4. A coil winding machine according to claim 3, further comprising a pivot lever means rearwardly projecting from the bearer means, said pivot lever means being pivotally connected with a pivot drive means arranged between the pivot lever means and a pedestal support means and below a corresponding support arm.

5. A coil winding machine according to claim 4, wherein said pivot drive means includes a fluid cylinder.

6. A coil winding machine according to claim 4, wherein said pivot drive means includes an electro-spindle drive.

7. A coil winding machine according to claim 4, wherein said displacement means includes adjacent independent guide track means on the bearer means, carriage means for arranging the winding material feed means at said guide track means displaceable and movable past one another.

8. A coil winding machine according to claim 7, wherein:

a first winding material feed means includes a supply roller means, a tape brake means and associated first guide roller means displaceably arranged on a lower one of said guide track means, a second winding material feed means includes a strip supply roller means with associated second guide roller means extending over the first guide roller means displaceably arranged on a middle of one of said guide track means, and a third winding material feed means includes a wire removal roller means, a wire brake means, and a third guide roller means extending over the first and second guide roller means displaceably arranged on an upper of said guide track means.

9. A coil winding machine according to claim 8, wherein the supply roller means, the wire withdrawal roller means and the wire brake means are provided one above the other to the rear of the bearer means and the strip supply roller means is provided in front of the bearer means between the support arms for the first and the third guide roller means.

10. A coil winding machine according to claim 9, wherein said bearer means is constructed as rectangular tubular member.

11. A coil winding machine according to claim 1, wherein said support means includes a guide bed means, pedestal support means each including a rearwardly projecting support arm provided at ends of the guide bed means, the bearer means being supported at the support arms.

12. A coil winding machine according to claim 11, further comprising a pivot lever means rearwardly projecting from the bearer means, said pivot lever means being pivotally connected with a pivot drive means arranged between the pivot lever means and a pedestal support means and below a corresponding support arm.

13. A coil winding machine according to claim 1, wherein said bearer means is constructed as rectangular tubular member.

14. A coil winding machine according to claim 2, further comprising a pivot lever means rearwardly projected from the bearer means, said pivot lever means being pivotally connected with a pivot drive means.

15. A coil winding machine according to claim 7, wherein said displacement means includes an individual motor means for adjusting the position of said carriage on said guide track means.

16. A coil winding machine comprising:

support means;

clamping and rotating means for clamping and rotating a coil about a horizontal axis of rotation of said support means;

a plurality of winding material feed means;

a common bearer means pivotally mounted to said support means about an axis disposed to the rear of the axis of rotation of the coil and means for rotating said bearer means from a winding pivotal position to a retracted pivotal position removing said winding material feed means from the space vertically above the coil so that the coil can be removed vertically upwardly;

adjacent independent guide track means on the bearer means;

carriage means for arranging the winding material feed means at said guide track means displaceable and movable past one another and mounting said winding material feed means to rotate with said common bearer means.

17. A coil winding machine according to claim 16, wherein:

a first winding material feed means includes a supply roller means, a tape brake means and associated first guide roller means displaceably arranged on a lower one of said guide track means, a second winding material feed means includes a strip supply roller means with associated second guide roller means extending over the first guide roller means displaceably arranged on a middle of one of said guide track means, and a third winding material feed means including a wire removal roller means, a wire brake means, and a third guide roller means extending over the first and second guide roller means displaceably arranged on an upper of said guide track means.

18. A coil winding machine according to claim 17, wherein the supply roller means, the wire withdrawal roller means and the wire brake means are provided one above the othr to the rear of the bearer means and the strip supply roller means is provided in front of the bearer means between support arms for the first and the third guide roller means.

19. A coil winding machine according to claim 16, wherein said carriage means includes individual motor means for displacing said winding material feed means on said common bearer means.

* * * * *